United States Patent [19]

Röck et al.

[11] 4,320,934

[45] Mar. 23, 1982

[54] PULL-OUT GUIDE FOR DRAWERS

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 45,266

[22] Filed: Jun. 4, 1979

[30] Foreign Application Priority Data

Jun. 13, 1978 [AT] Austria ..... 4287/78
Oct. 31, 1978 [AT] Austria ..... 7767/78

[51] Int. Cl.[3] ..... A47B 88/08

[52] U.S. Cl. ..... 312/331; 308/3.6; 312/348

[58] Field of Search ..... 312/330 R, 330 SM, 331, 312/341 R, 344, 348, 334; 308/3.6, 3.8

[56] References Cited

U.S. PATENT DOCUMENTS

| | | | |
|---|---|---|---|
| 1,067,404 | 7/1913 | Callaghan | 312/331 |
| 1,252,867 | 1/1918 | Wall | 312/331 |
| 1,758,550 | 5/1930 | Wolters | 312/331 |
| 2,565,784 | 8/1951 | Sheean | 312/341 R |
| 3,387,907 | 6/1968 | Wall | 308/3.6 |
| 4,070,076 | 1/1978 | Zwillinger | 312/341 R |

OTHER PUBLICATIONS

Offenlegungsschrift, No. 2,328,453 to Hefendehl, 12/74.
Offenlegungsschrift, No. 2217853 to Schock, 10/73.

*Primary Examiner*—Roy D. Frazier
*Assistant Examiner*—Alexander Grosz
*Attorney, Agent, or Firm*—Wenderoth, Lind & Ponack

[57] ABSTRACT

A pull-out guide for drawers with which the drawer can be pulled completely free of the cabinet and is still held in the latter has a structure such that on each side of the drawer is a holding member attached to the drawer and a holding member attached to the side wall of the cabinet, both holding members being elongated and have a running surface for a roller placed between the holding members and mounted in the middle of an intermediate rail. The holding members have a rack profile and a part of the roller is a pinion engaging in the racks.

5 Claims, 8 Drawing Figures

PULL-OUT GUIDE FOR DRAWERS

BACKGROUND OF THE INVENTION

1. Field of the Invention

The invention relates to a pull-out guide for drawers and includes one rail movably mounted on either side of the drawer between holding members disposed on the side of the body and on the side of the drawer, the rail making a relative movement with respect of the body as well as in respect to the drawer, when the drawer is pulled out or pushed in.

2. Description of the Prior Art

Such pull-out guides are widely used in modern furniture production, particularly in the production of kitchen and office furniture. It is their task to facilitate the moving of the drawer. Moreover, it is their task to hold the drawers in the body of the cabinet or the like and prevent their tilting over in the pulled-out position.

In order to give free access to the objects in the drawer, it should be possible to pull the drawer fully or almost fully clear of the body of the piece of furniture.

SUMMARY OF THE INVENTION

It is the object of the present invention to provide a pull-out guide of the above-mentioned type in which the movement in the rail, being a so-called intermediate rail, is uniform and controlled.

The rail should move exactly half the path of the drawer, when the drawer is pulled out of the body of the piece of furniture or pushed in.

According to the invention this is achieved by providing a wheel being fastened to the center of the rail and differentially moving between the holding members on the side of the body and on the side of the drawer.

One embodiment of the invention provides that the holding members, one on the side of the body and one on the side of the drawer, have a rack profile, and that a wheel mounted in the center of the rail is a cog wheel mating with the rack profiles of the holding members.

By means of this embodiment a restrained guiding of the holding members on the side of the body and on the side of the drawer is obtained.

A particularly preferred embodiment provides that the wheel has a toothed ring extending over only a part of the axial length of the wheel. In this embodiment the holding members on the side of the body and on the side of the drawer move differentially and relative to each other on the tooth-free ring portion of the wheel. The cogs of the wheel only being to function when there is a slip between the hub of the running surface of the upper and lower holding members. Thereby a particularly silent and easy running pull-out guide for drawers is provided.

A further embodiment of the invention provides that the rail has a U-shaped profile and including two horizontal flanges projecting into guiding grooves of the holding members. Thereby the rail is securely guided in the holding means and, above all, prevented from tilting.

It is a further object of the invention to provide higher stability for the drawer in one of its end positions, e.g. when fully pushed into the body of the piece of furniture, or in both end positions, i.e. also when the drawer is fully pulled out of the body of the piece of furniture. Thus, the drawer cannot be unintentionally moved from its actual end positions.

According to the invention this is achieved by providing a recess on at least one end of at least one rack profile the wheel engaging said recess, when the drawer is in one of its two end positions.

One embodiment of the invention provides that the recess is bow-shaped.

A further preferred embodiment provides that the front and rear edge of the recess are at the same level.

When the rack profile on the side of the body has a recess on its front side and/or when the rack profile on the side of the drawer has a recess on its rear side, the drawer is secured in its pulled-out position. This is of advantage when objects are being placed into the drawer, since the drawer cannot be moved into the body of the piece of furniture by exerting only slight pressure.

BRIEF DESCRIPTION OF THE DRAWINGS

In the following various embodiments of the invention will be described in more detail with reference to the accompanying drawings, without being limited thereof, and wherein:

FIGS. 6 and 7 are schematic views of two further embodiments, with the drawer pushed in.

DETAILED DESCRIPTION OF THE PREFERRED EMBODIMENTS

Figure 1:
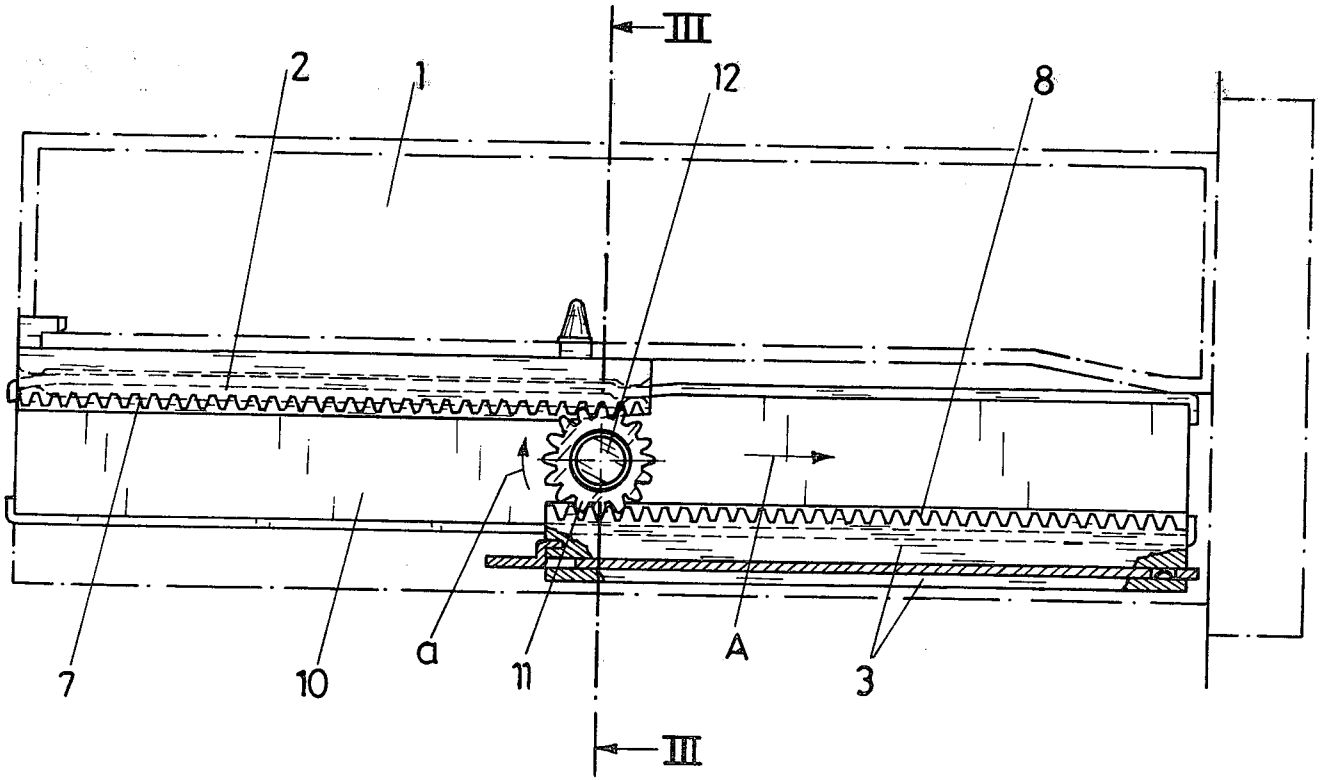
FIG. 1 is a schematic side view of the pull-out guide, when the drawer is closed.

As can be seen in the drawings, a drawer 1 is provided on the rear half thereof with a holding member 2. A holding member 3 is fixed to the side-wall 6 of a piece of furniture at a position adjacent the front part, more precisely extending over more than the front half, of the body of the piece of furniture.

The holding member 2 is directly fixed to the plastic profile of the drawer side-wall 1' by means of tenons or projections 4 molded to holding member 2. The holding member 3 is fastened to the furniture side-wall 6 by means of a fastening rail 5.

The two holding members 2 and 3 are rail-like, one of the rims or edges of each being provided with rack profiles 7, 8, respectively. Both holding members 2, 3 are provided with guiding grooves 9 having L-shaped profiles. A rail 10 has horizontal flanges 10' mounted in guiding grooves 9. A wheel 11 is mounted on a bolt 12 in the center of the rail 10.

The wheel 11 has a pinion or toothed ring 13 extending axially only over a small portion of the surface 11' of the wheel 11. The tooth-free portion of the surface 11' of the wheel 11 serves as an ordinary roller between the holding member 3 on the side of the body and the holding member 2 on the side of the drawer.

Figure 2:
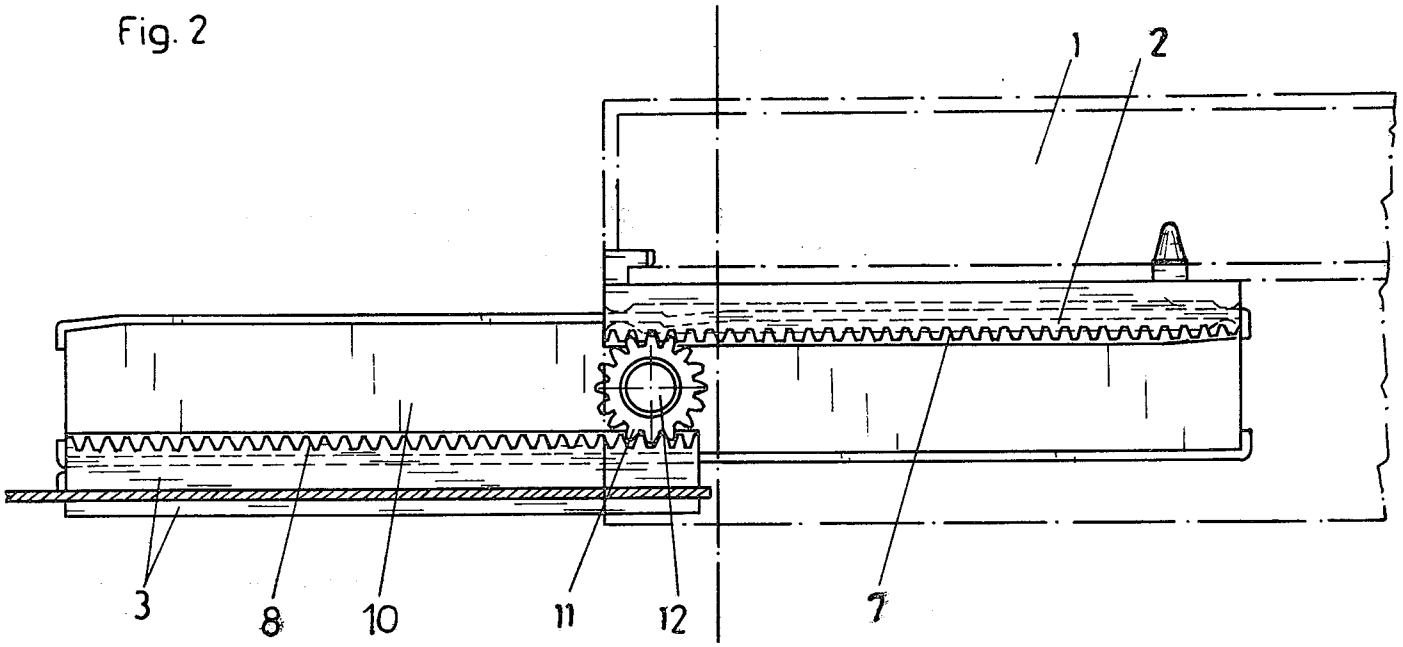
FIG. 2 is a view similar to FIG. 1, but with the drawer pulled out.
Figure 3:
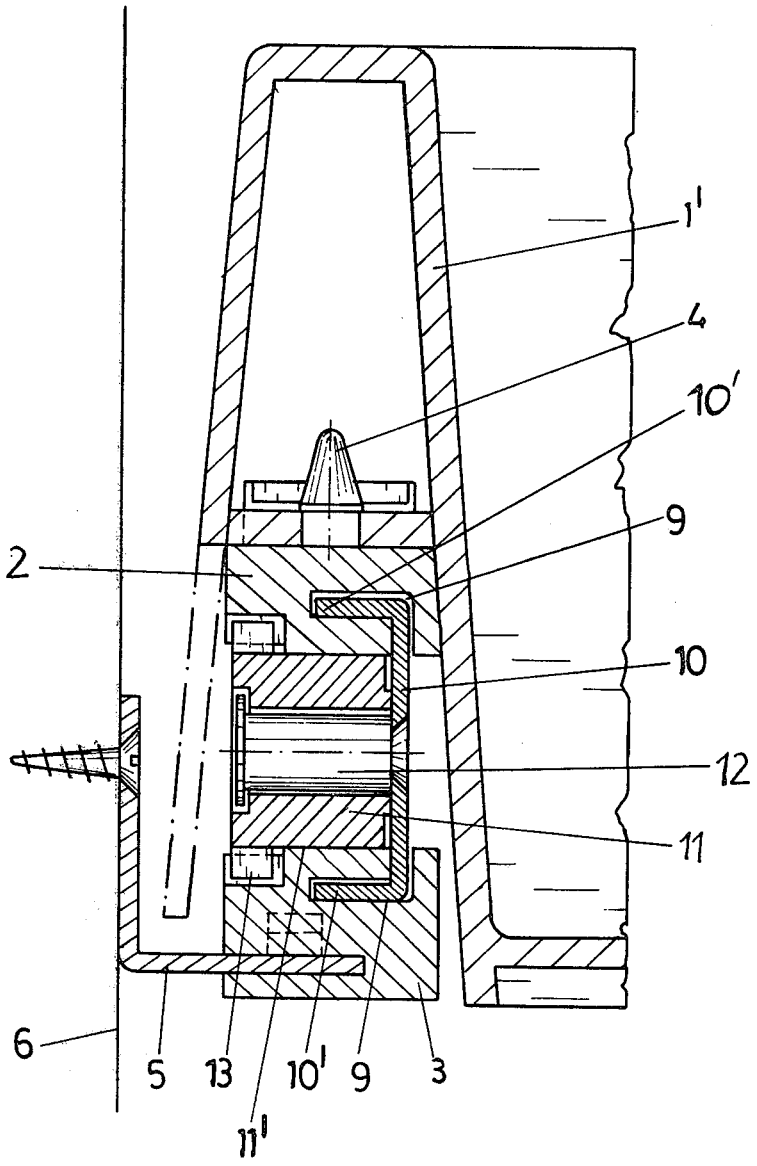
FIG. 3 is a section along line III—III of FIG. 1.

When the drawer 1 is pushed in, the holding members 2, 3 are in the position illustrated in FIG. 1. The same is true for the rail 10 and the wheel 11. When the drawer is opened, the wheel 11 is turned into the direction of arrow a by means of the holding member 2. Wheel 11 and rail 10 move in the direction of arrow A until they reach the position illustrated in FIG. 2, when the drawer 1 is fully pulled out.

Figure 4:
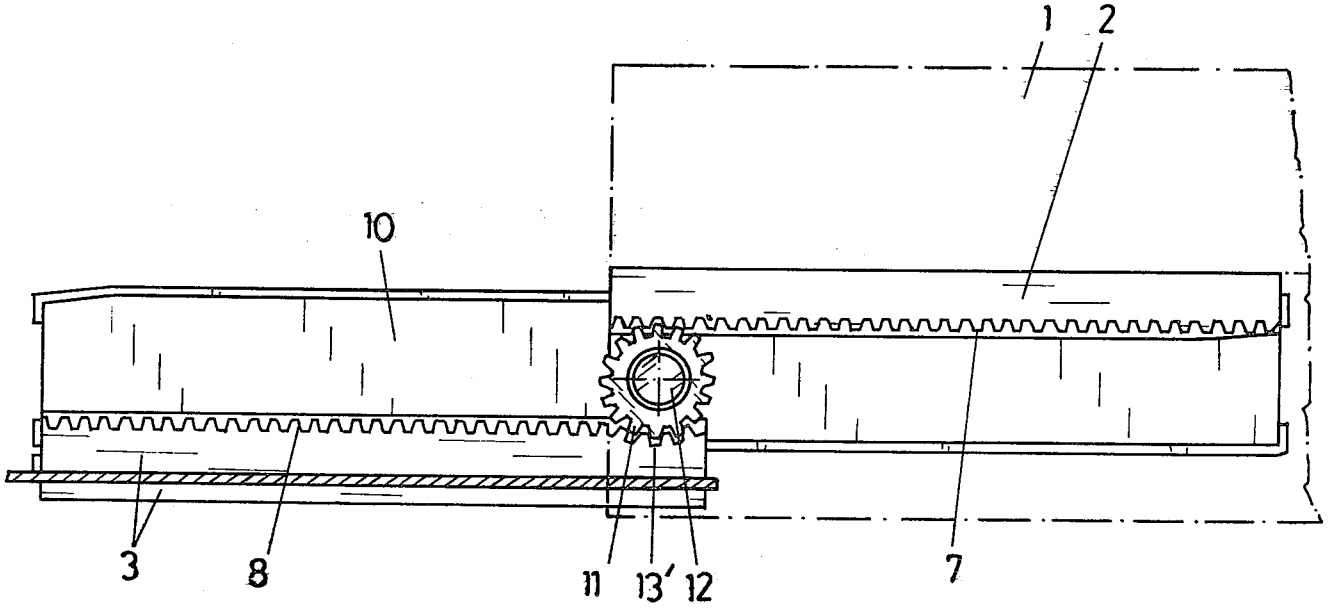
FIGS. 4 and 5 are schematic views of two modified embodiments, with the drawer pulled out.
Figure 5:
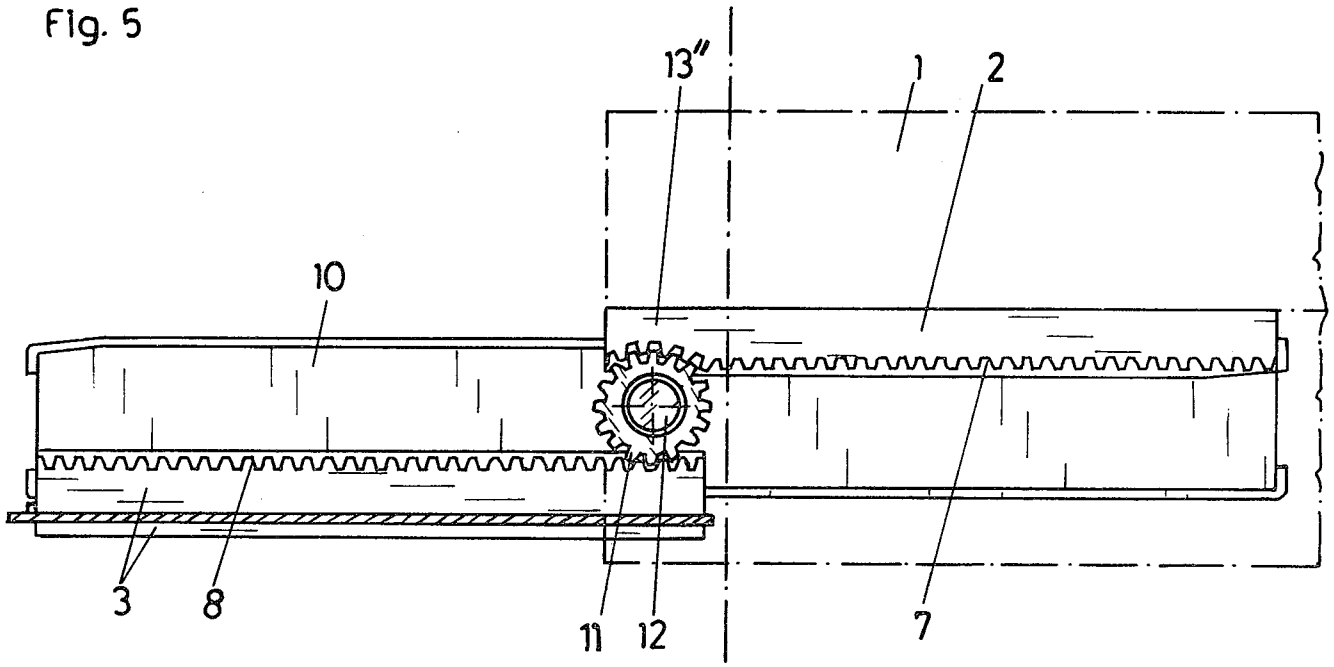
Figure 6:
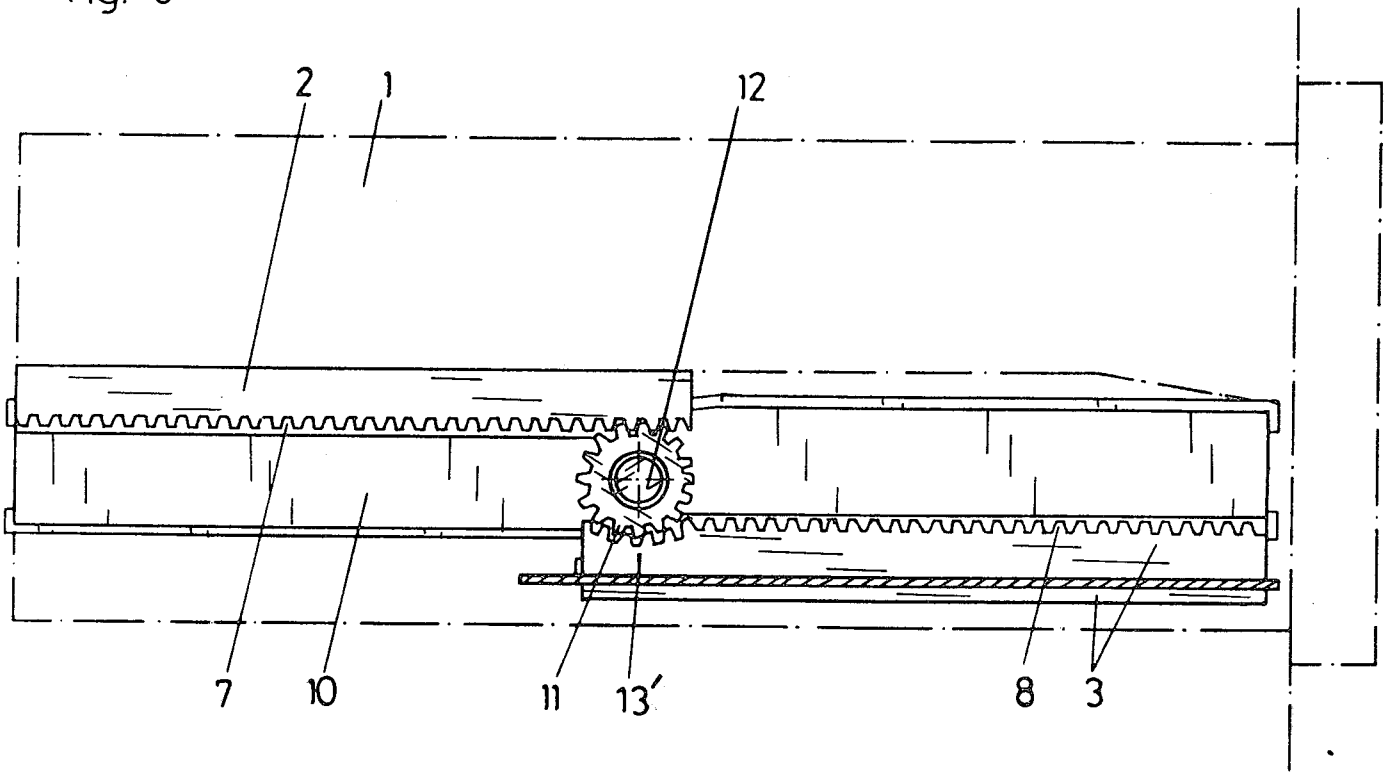
Figure 7:
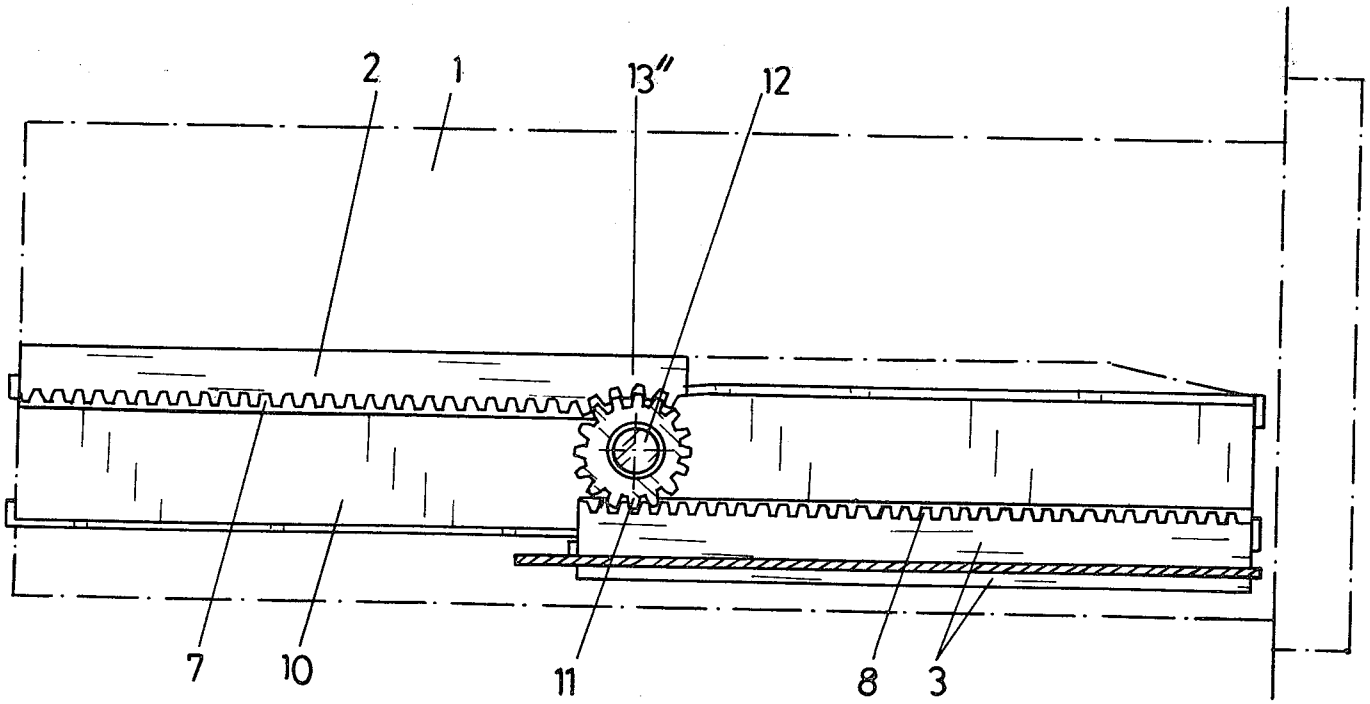
Figure 8:
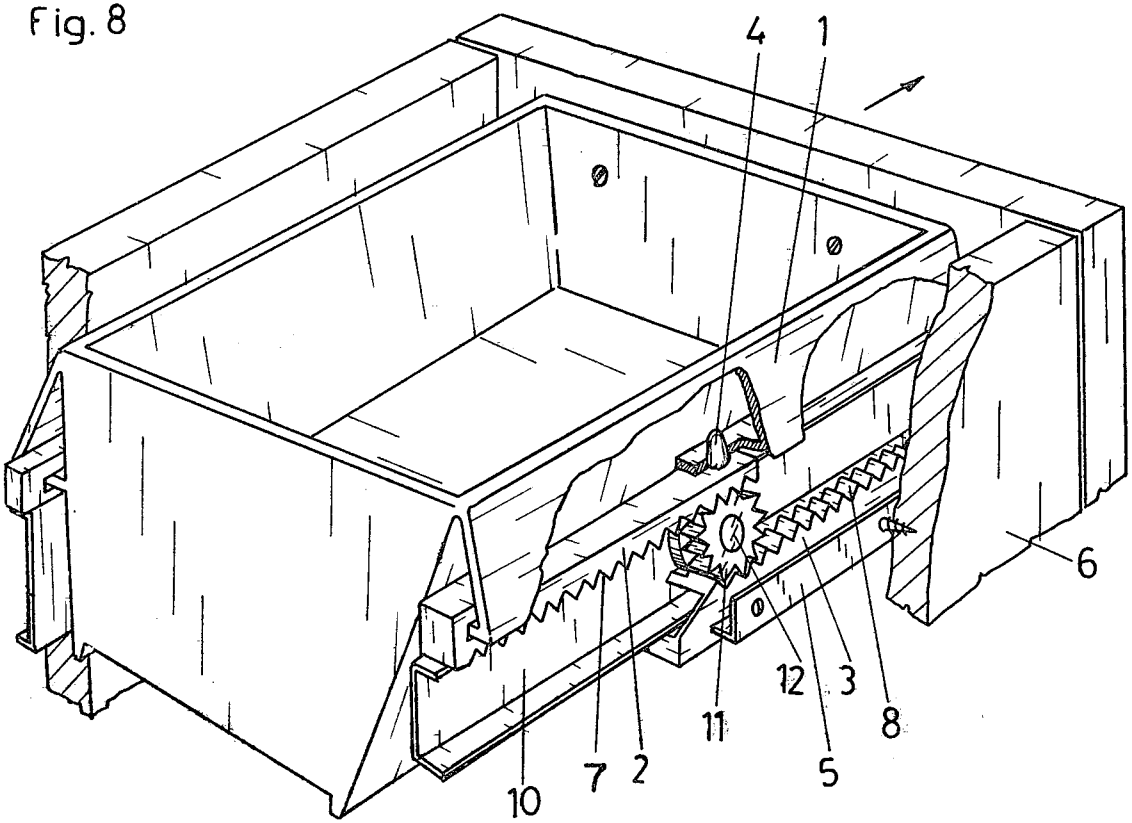
FIG. 8 is a three-dimensional view of a pull-out guide mounted in a drawer.

When the rear and front sides of the rack profile 8 on the side of the body (FIGS. 4 and 6) and/or the front and rear sides of the plastic profile 7 on the side of the drawer (FIGS. 5 and 7) are provided with recesses 13' and 13'', respectively, the drawer 1 must be slightly lifted when being pulled out, thus necessitating a stronger pull on the drawer 1. The drawer 1 being not fully pushed into the body of the piece of furniture is automatically drawn into the body, when the wheel 11 gets into the region of the recess 13' or recesses 13''.

The part of the holding member 2 or 3 in the region of the recesses 13' or 13'' must also have recesses, which can be greater than the recesses 13' or 13'' of the rack profiles 7 or 8. The holding members 2, 3 adjacent to the rack profile can be broken away. It is of importance that the toothed ring 13 of the wheel 11 can unhinderedly engage the recesses 13' or 13''.

What is claimed is:

1. A pull-out guide assembly for use on each of opposite sides of a drawer in an article of furniture of the type wherein the drawer is slidably insertable into and removable from a furniture body, said assembly comprising:

a plastic drawer side wall having a substantially inverted V-shaped cross-section;

a first holding member attached to said drawer side wall at a position within said V-shaped cross-section thereof, said first holding member comprising a substantially solid elongated plastic first block extending over only along slightly more than the rear half of the length of said drawer side wall;

a second holding member adapted to be attached to a side wall of a furniture body adjacent said drawer side wall, said second holding member comprising a substantially solid elongated second block having a length to extend only along slightly more than the front half of the length of the furniture body side wall;

said first and second blocks having formed therein respective first and second elongated L-shaped guiding grooves;

said first and second blocks having formed in confronting surfaces thereof respective first and second racks;

an elongated rail having a substantially U-shaped cross-section including a vertical web connecting spaced horizontal first and second flanges, said rail being mounted in said first and second blocks for sliding movement relative thereto, with said first and second horizontal flanges being positioned within said first and second guiding grooves, respectively; and a cog wheel rotatably mounted about a horizontal axis to said vertical web of said rail at a position midlength thereof said cog wheel extending transversely between said first and second blocks, said cog wheel having a first axial length portion in the form of a pinion meshing with both said first and second racks, and said cog wheel having a second axial length portion which is tooth-free and which rollingly contacts surfaces of said first and second blocks;

whereby movement of the drawer into and from the furniture body will cause said first rack to rotate said pinion with respect to said first and second racks, and thereby causing relative longitudinal movement of said cog wheel and said rail with respect to both said first and second blocks.

2. An assembly as claimed in claim 1, wherein said first block includes integral upwardly extending projections connected to said drawer side wall.

3. An assembly as claimed in claim 1, wherein at least one end of at least one of said first and second racks has formed therein a recess, and said pinion is engaged and positioned within said recess when the drawer is in the respective end position.

4. An assembly as claimed in claim 3, wherein said recess is bow-shaped.

5. An assembly as claimed in claims 3 or 4, wherein front and rear edges of said recess are at the same horizontal level.

* * * * *